US009691330B2

(12) United States Patent
Lee et al.

(10) Patent No.: US 9,691,330 B2
(45) Date of Patent: Jun. 27, 2017

(54) ORGANIC LIGHT EMITTING DIODE DISPLAY DEVICE AND METHOD DRIVING THE SAME

(71) Applicant: LG Display Co., Ltd., Seoul (KR)

(72) Inventors: Jung Min Lee, Paju-si (KR); Chang Heon Kang, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 163 days.

(21) Appl. No.: 14/586,587

(22) Filed: Dec. 30, 2014

(65) Prior Publication Data

US 2015/0187281 A1 Jul. 2, 2015

(30) Foreign Application Priority Data

Dec. 31, 2013 (KR) ..... 10-2013-0167966

(51) Int. Cl.

*G09G 3/3291* (2016.01)
*G09G 3/3258* (2016.01)
*G09G 3/3266* (2016.01)
*G09G 3/3233* (2016.01)

(52) U.S. Cl.

CPC ..... *G09G 3/3291* (2013.01); *G09G 3/3233* (2013.01); *G09G 3/3258* (2013.01); *G09G 3/3266* (2013.01); *G09G 2300/0465* (2013.01); *G09G 2300/0819* (2013.01);

(Continued)

(58) Field of Classification Search

CPC ... G09G 2300/0465; G09G 2300/0861; G09G 3/3258; G09G 3/3266; G09G 3/3291

See application file for complete search history.

(56) References Cited

U.S. PATENT DOCUMENTS

2005/0052377 A1* 3/2005 Hsueh ..... G09G 3/3233 345/82
2006/0244688 A1 11/2006 Ahn et al.
2008/0197785 A1 8/2008 Uchino et al.

(Continued)

FOREIGN PATENT DOCUMENTS

CA 2495726 A1 7/2006
CN 101593767 A 12/2009

(Continued)

OTHER PUBLICATIONS

English translation of CN-103150992-A, dated Jun. 12, 2013.

*Primary Examiner* — Viet Pham
(74) *Attorney, Agent, or Firm* — Birch, Stewart, Kolasch & Birch, LLP

(57) ABSTRACT

Provided is an OLED display device including a plurality of pixel each of which includes a light emitting element and a cell driver configured to drive the light emitting element. The cell driver includes: a driving switch element serially connected with the light emitting element between a high voltage supply line and a low voltage supply line; a first switch element configured to, in response to a second scan signal, connect a data line with a first node to which a gate electrode of the driving switch element is connected; a second switch element configured to, in response to a first scan signal, apply a third scan signal to a second node to which a source electrode of the driving switch element is connected; and a third switch element configured to, in response to an emission signal, connect the high voltage supply line with a drain electrode of the driving switch element.

11 Claims, 8 Drawing Sheets

(52) U.S. Cl.
CPC ..... *G09G 2300/0852* (2013.01); *G09G 2300/0861* (2013.01); *G09G 2320/045* (2013.01)

(56) References Cited

U.S. PATENT DOCUMENTS

| | | | | |
|---|---|---|---|---|
| 2009/0295772 | A1 | 12/2009 | Kim et al. | |
| 2010/0053144 | A1 | 3/2010 | Akimoto et al. | |
| 2010/0128021 | A1 | 5/2010 | Kang et al. | |
| 2011/0164021 | A1 | 7/2011 | Seto | |
| 2012/0013597 | A1* | 1/2012 | Han ..... | G09G 3/3233 345/212 |
| 2014/0184665 | A1 | 7/2014 | Yoon et al. | |

FOREIGN PATENT DOCUMENTS

| | | | |
|---|---|---|---|
| CN | 101661707 | A | 3/2010 |
| CN | 101739948 | A | 6/2010 |
| CN | 103150992 | A | 6/2013 |
| CN | 103915061 | A | 7/2014 |
| EP | 2189967 | A2 | 5/2010 |

* cited by examiner

ORGANIC LIGHT EMITTING DIODE DISPLAY DEVICE AND METHOD DRIVING THE SAME

CROSS REFERENCE TO RELATED APPLICATION

The present application claims priority to Korean Patent Application No. 10-2013-0167966 filed on Dec. 31, 2013, which is hereby incorporated by reference for all purposes as if fully set forth herein.

BACKGROUND OF THE INVENTION

Field of the Disclosure

The present application relates to an organic light emitting diode (OLED) display device and a method driving the same.

Description of the Related Art

Recently, a variety of flat panel display devices with reduced weight and volume to overcome the disadvantages of cathode ray tube (CRT) are being developed. The flat panel display devices include liquid crystal display (LCD) devices, field emission display (FED) devices, plasma display panels (PDPs), electroluminescence devices and so on.

The PDPs have advantages such as a simple manufacture process, lightness and thinness, and are easy to provide a large-sized screen. In view of these points, the PDPs attract consumers' attention. However, the PDPs have serious problems such as low light emission efficiency, low brightness and high power consumption.

Thin film transistor LCD devices are widely used as the flat display devices. However, the thin film transistor LCD devices have disadvantages such as a narrow viewing angle and a low response time.

The electroluminescence display devices are classified into an inorganic light emitting diode display device and an OLED display device on the basis of the formation material of a light emission layer. The OLED display device corresponding to a self-illuminating display device has features such as high response time, high light emission efficiency, high brightness and wide viewing angle.

The OLED display device is configured with a plurality of pixels. Each of the pixels includes an OLED and a cell driver configured to drive each OLED. The OLED includes an anode electrode, a cathode electrode and an organic emission layer interposed between the anode and cathode electrodes. The cell driver generally includes a switching thin film transistor (hereinafter, 'TFT'), a capacitor and a driving TFT. The switching TFT transfers a data voltage into the capacitor in response to a scan pulse. The driving TFT controls the quantity of light emitted from the OLED by adjusting the current quantity applied to the OLED on the basis of the data voltage which is charged into the capacitor.

An OLED display device and a driving method thereof according to the related art will now be described.

FIG. 1 is a waveform diagram illustrating a method of driving an OLED display device according to the related art. FIG. 2 is a circuit diagram showing an OLED display device of the related art. FIG. 3 is a planar view showing OLED pixels of the related art. FIG. 4 is a cross-sectional view showing a sectional structure of the OLED pixel according to the related art taken along a line a-a' in FIG. 3.

Referring to FIGS. 1 and 2, each pixel P of the OLED display device according to the related art is driven in such a manner as to be divided into an initialization interval t1, a sampling interval t2, a programming interval t3 and an emission interval t4 according to a timing chain defined by a plurality of pulse signals.

In the initialization interval t1, first and second scan signals SCAN1 and SCAN2 with a high logic level and an emission signal EM with a low logic level are output. The first scan signal SCAN1 and the emission signal EM each have the high logic level, but the second scan signal SCAN2 has the low logic level, during the sampling interval t2. During the programming interval t3, the first scan signal SCAN1 maintains the high logic level but the second scan signal SCAN2 and the emission signal EM each have the low logic level. In the emission interval t4, the emission signal EM with the high logic level and the first and second scan signals SCAN1 and SCAN2 with the low logic level are output.

A second TFT T2 transfers a reference voltage Vinit applied from an initialization voltage supply line Vinit to a second node N2 during the initialization interval t1. To this end, the second TFT T2 is controlled by the second scan signal SCAN2.

In order to apply the reference voltage Vinit to the second node N2 in the initialization interval t1, it is necessary to provide the initialization voltage supply line Vinit.

As shown in FIGS. 3 and 4, each pixel P of the OLED display device according to the related art can include an anode electrode 10, a cathode electrode 20 and an organic emission layer 30 interposed between the anode and cathode electrodes 10 and 20. The initialization voltage supply line Vinit used to apply the reference voltage Vinit to the anode electrode 10 is formed in a region between the pixels P.

Such an initialization voltage supply line used for the anode electrode 10 cannot help but limiting the vertical length of the anode electrode 10. In other words, the anode electrode cannot help but being limited by the initialization voltage supply line on the up and down sides. Due to this, it is difficult to enhance the aperture ratio of the organic emission layer 30.

Moreover, additional circuit components used to apply the initialization voltage (or the reference voltage) Vinit must be included in the OLED display device, which results in the increased size of the bezel region.

SUMMARY OF THE INVENTION

Accordingly, embodiments of the present application are directed to an OLED display device and a driving method thereof that substantially obviate one or more of problems due to the limitations and disadvantages of the related art.

The embodiments relate to provide an OLED display device and a driving method thereof which are adapted to enhance an aperture ratio of an organic material deposition region by removing an initialization voltage supply line.

Also, the embodiments relate to provide an OLED display device and a driving method thereof which are adapted to minimize a bezel region by removing circuit components which are used to apply an initialization voltage.

Additional features and advantages of the embodiments will be set forth in the description which follows, and in part will be apparent from the description, or may be learned by practice of the embodiments. The advantages of the embodiments will be realized and attained by the structure particularly pointed out in the written description and claims hereof as well as the appended drawings.

According to one general aspect of the embodiments, an OLED display device includes a plurality of pixels each including a light emitting element and a cell driver configured to drive the light emitting element. The cell driver includes: a driving switch element serially connected with the light emitting element between a high voltage supply line and a low voltage supply line; a first switch element configured to reply to a second scan signal and connect a data line and a first node, to which a gate electrode of the driving switch element is connected to, to each other; a second switch element configured to reply to a first scan signal and apply a third scan signal to a second node to which a source electrode of the driving switch element is connected; and a third switch element configured to reply to an emission signal and connect the high voltage supply line and a drain electrode of the driving switch element to each other.

The OLED display device according to one general aspect of the present embodiments further includes a first capacitor connected between the first node and the second node.

The OLED display device according to one general aspect of the present embodiments further includes a second capacitor connected between the second node and the high voltage supply line and configured to relatively reduce a capacitance ratio of the first capacitor and brightness of the light emitting element with respect to a data voltage which is applied from the data line to the respective pixel.

The OLED display device according to one general aspect of the present embodiments allows: the first scan signal to be applied from an (i−1)th gate line; the second scan signal to be applied from an ith gate line; and the third scan signal to be applied from an (i+1)th gate line.

An OLED display device according to another general aspect of the present embodiments includes a plurality of pixels each including a light emitting element and a cell driver configured to drive the light emitting element. The cell driver includes: a driving switch element serially connected with the light emitting element between a high voltage supply line and a low voltage supply line; a first switch element configured to reply to a second scan signal and connect a data line and a first node, to which a gate electrode of the driving switch element is connected to, to each other; a second switch element configured to reply to a first scan signal and apply the second scan signal to a second node to which a source electrode of the driving switch element is connected; and a third switch element configured to reply to an emission signal and connect the high voltage supply line and a drain electrode of the driving switch element to each other.

The OLED display device according to another general aspect of the present embodiments further includes a first capacitor connected between the first node and the second node.

The OLED display device according to another general aspect of the present embodiments further includes a second capacitor connected between the second node and the high voltage supply line and configured to relatively reduce a capacitance ratio of the first capacitor and brightness of the light emitting element with respect to a data voltage which is applied from the data line to the respective pixel.

The OLED display device according to another general aspect of the present embodiments allows: the first scan signal to be applied from an (i−1)th gate line; and the second scan signal to be applied from an ith gate line.

A method of driving an OLED display device according to still another general aspect of the present embodiments is applied to an OLED display device with a plurality of pixels each including a light emitting element and a cell driver which is configured to drive the light emitting element and include: a driving switch element serially connected with the light emitting element between a high voltage supply line and a low voltage supply line; a first switch element configured to reply to a second scan signal and connect a data line and a first node, to which a gate electrode of the driving switch element is connected to, to each other; a second switch element configured to reply to a first scan signal and apply a third scan signal to a second node to which a source electrode of the driving switch element is connected; and a third switch element configured to reply to an emission signal and connect the high voltage supply line and a drain electrode of the driving switch element to each other. The method includes: an initialization process initializing the second node by turning-on the second switch element; a sampling process sensing a threshold voltage of the driving switch element by turning-on the first and third switch elements; a programming process writing the data voltage into the respective pixel by turning-on the first switch element; and an emission process enabling the driving switch element to apply a driving current to the light emitting element by turning-on the third switch element.

In the method according to still another general aspect of the present embodiments, the initialization process allows the third scan signal to be applied to the second node by turning-on the second switch element.

The method according to still another general aspect of the present embodiments allows the sampling process to include: applying a reference voltage applied to from the data line to the first node by turning-on the first switch element; supplying the high voltage applied from the high voltage supply line to the drain electrode of the driving switch element by turning-on the third switch element; and enabling a voltage at the source electrode of the driving switch element to be varied into a voltage of "Vref−Vth". The "Vref" is the reference voltage and the "Vth" is the threshold voltage of the driving switch element'.

The method according to still another general aspect of the present embodiments enables the programming process to include: applying the data voltage applied from the data line to the first node by turning-on the first switch element; relatively reducing a capacitance ratio of a first capacitor, which is connected between the first node and the second node, using a second capacitor connected between the second node and the high voltage supply line; and allowing a voltage at the source electrode of the driving switch element to be varied into a voltage of "Vref−Vth+C'(Vdata−Vref)". The "Vdata" is the data voltage, the "C'" is the capacitance ratio of "C1/(C1+C2+Coled)", the "C1" is a capacitance of the first capacitor, the "C2" is a capacitance of the second capacitor, and the "Coled" is a capacitance of the light emitting element.

The method according to still another general aspect of the present embodiments enables the emission process to include: applying the high voltage applied from the high voltage supply line to the drain electrode of the driving switch element by turning-on the third switch element; and allowing the driving current, which is applied from the driving switch element to the light emitting element, to become "K/2·{Vdata−Vref−C'(Vdata−Vref)}·2". The "K" is a constant value in accordance with mobility and parasitic capacitance of the driving switch element.

A method of driving an OLED display device according to further still another general aspect of the present embodiments is applied to an OLED display device with a plurality of pixels each including a light emitting element and a cell driver which is configured to drive the light emitting element and include: a driving switch element serially connected with the light emitting element between a high voltage supply line and a low voltage supply line; a first switch element configured to reply to a second scan signal and connect a data line and a first node, to which a gate electrode of the driving switch element is connected to, to each other; a second switch element configured to reply to a first scan signal and apply the second scan signal to a second node to which a source electrode of the driving switch element is connected; and a third switch element configured to reply to an emission signal and connect the high voltage supply line and a drain electrode of the driving switch element to each other. The method includes: an initialization process initializing the second node by turning-on the second switch element; a sampling process sensing a threshold voltage of the driving switch element by turning-on the first and third switch elements; a programming process writing the data voltage into the respective pixel by turning-on the first switch element; and an emission process enabling the driving switch element to apply a driving current to the light emitting element by turning-on the third switch element.

In the method according to further still another general aspect of the present embodiments, the initialization process allows the second scan signal to be applied to the second node by turning-on the second switch element.

The method according to further still another general aspect of the present embodiments allows the sampling process to include: applying a reference voltage applied to from the data line to the first node by turning-on the first switch element; supplying the high voltage applied from the high voltage supply line to the drain electrode of the driving switch element by turning-on the third switch element; and enabling a voltage at the source electrode of the driving switch element to be varied into a voltage of "Vref−Vth". The "Vref" is the reference voltage and the "Vth" is the threshold voltage of the driving switch element'.

The method according to further still another general aspect of the present embodiments enables the programming process to include: applying the data voltage applied from the data line to the first node by turning-on the first switch element; relatively reducing a capacitance ratio of a first capacitor, which is connected between the first node and the second node, using a second capacitor connected between the second node and the high voltage supply line; and allowing a voltage at the source electrode of the driving switch element to be varied into a voltage of "Vref−Vth+C'(Vdata−Vref)". The "Vdata" is the data voltage, the "C'" is the capacitance ratio of "C1/(C1+C2+Coled)", the "C1" is a capacitance of the first capacitor, the "C2" is a capacitance of the second capacitor, and the "Coled" is a capacitance of the light emitting element.

The method according to further still another general aspect of the present embodiments enables the emission process to include: applying the high voltage applied from the high voltage supply line to the drain electrode of the driving switch element by turning-on the third switch element; and allowing the driving current, which is applied from the driving switch element to the light emitting element, to become "K/2·{Vdata−Vref−C'(Vdata−Vref)}·2". The "K" is a constant value in accordance with mobility and parasitic capacitance of the driving switch element.

Other systems, methods, features and advantages will be, or will become, apparent to one with skill in the art upon examination of the following figures and detailed description. It is intended that all such additional systems, methods, features and advantages be included within this description, be within the scope of the present disclosure, and be protected by the following claims. Nothing in this section should be taken as a limitation on those claims. Further aspects and advantages are discussed below in conjunction with the embodiments. It is to be understood that both the foregoing general description and the following detailed description of the present disclosure are exemplary and explanatory and are intended to provide further explanation of the disclosure as claimed.

BRIEF DESCRIPTION OF THE DRAWINGS

The accompanying drawings, which are included to provide a further understanding of the embodiments and are incorporated herein and constitute a part of this application, illustrate embodiment(s) of the present disclosure and together with the description serve to explain the disclosure. In the drawings.

DETAILED DESCRIPTION OF THE EMBODIMENTS

Figure 1:
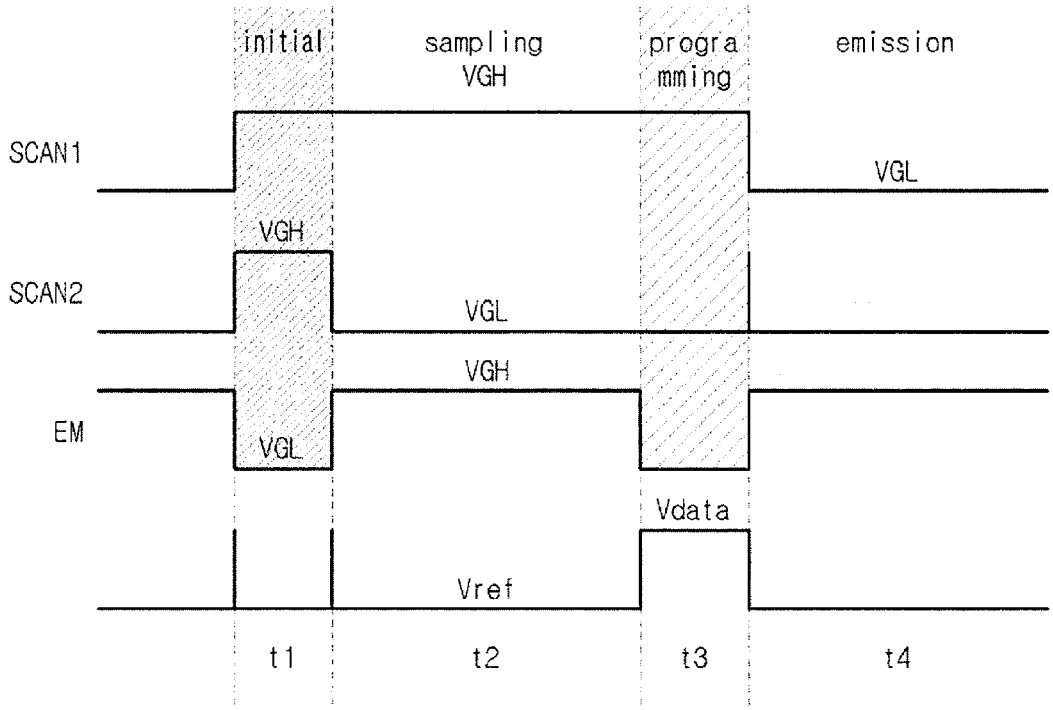
(Prior Art) FIG. 1
FIG. 1 is a waveform diagram illustrating a method of driving an OLED display device according to the related art.
Figure 2:
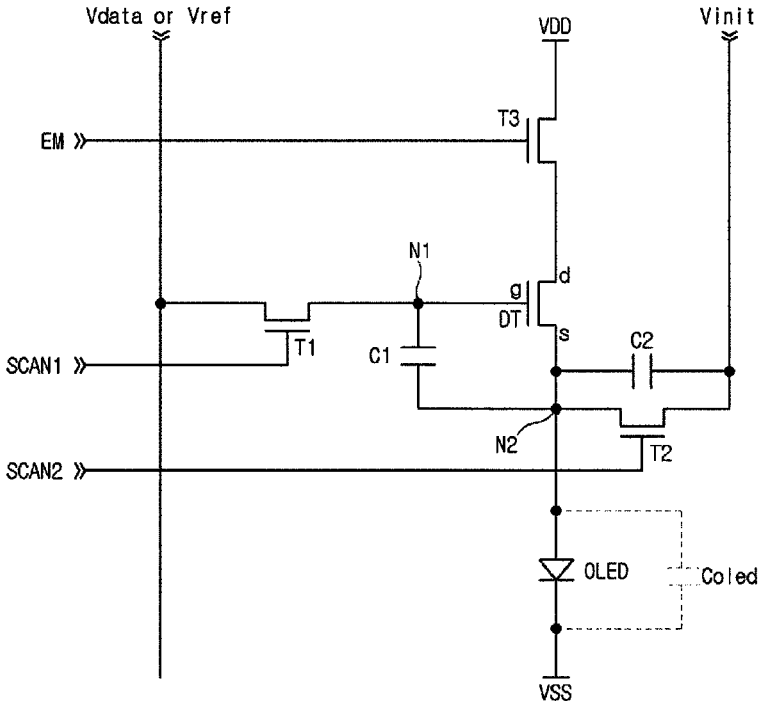
(Prior Art) FIG. 2
FIG. 2 is a circuit diagram showing an OLED display device of the related art.
Figure 3:
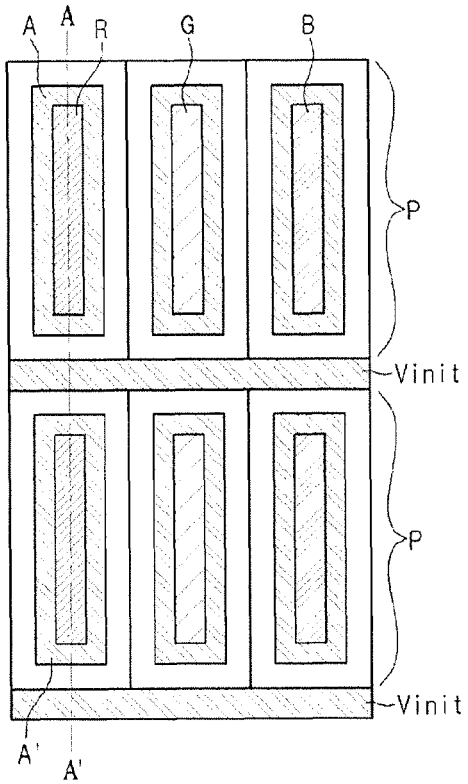
(Prior Art) FIG. 3
FIG. 3 is a planar view showing OLED pixels of the related art.
Figure 4:
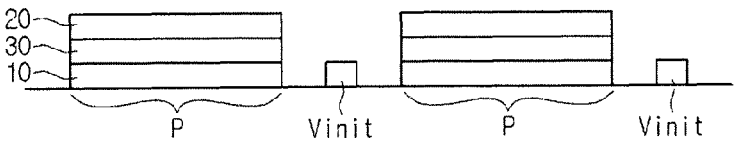
(Prior Art) FIG. 4
FIG. 4 is a cross-sectional view showing a sectional structure of the OLED pixel according to the related art taken along a line a-a' in FIG. 3.

Reference will now be made in detail to an OLED display device and a driving method thereof in accordance with the embodiments of the present disclosure, examples of which are illustrated in the accompanying drawings. These embodiments introduced hereinafter are provided as examples in order to convey their spirits to the ordinary skilled person in the art. Therefore, these embodiments might be embodied in a different shape, so are not limited to these embodiments described here. In the drawings, the size, thickness and so on of a device can be exaggerated for convenience of explanation. Wherever possible, the same reference numbers will be used throughout this disclosure including the drawings to refer to the same or like parts.

In the present disclosure, a TFT can become one of n-type and p-type TFTs. For convenience of explanation, the n-type TFT is used as an example of the TFT. As such, a gate high voltage is used as a gate-on voltage for turning-on the TFT, and a gate low voltage is used as a gate-off voltage for turning-off the TFT. Also, in pulse signals, a state of the gate high voltage (VGH) is defined as a 'high logic level' and another state of the gate low voltage VGL is defined as a 'low logic level'.

Figure 5:
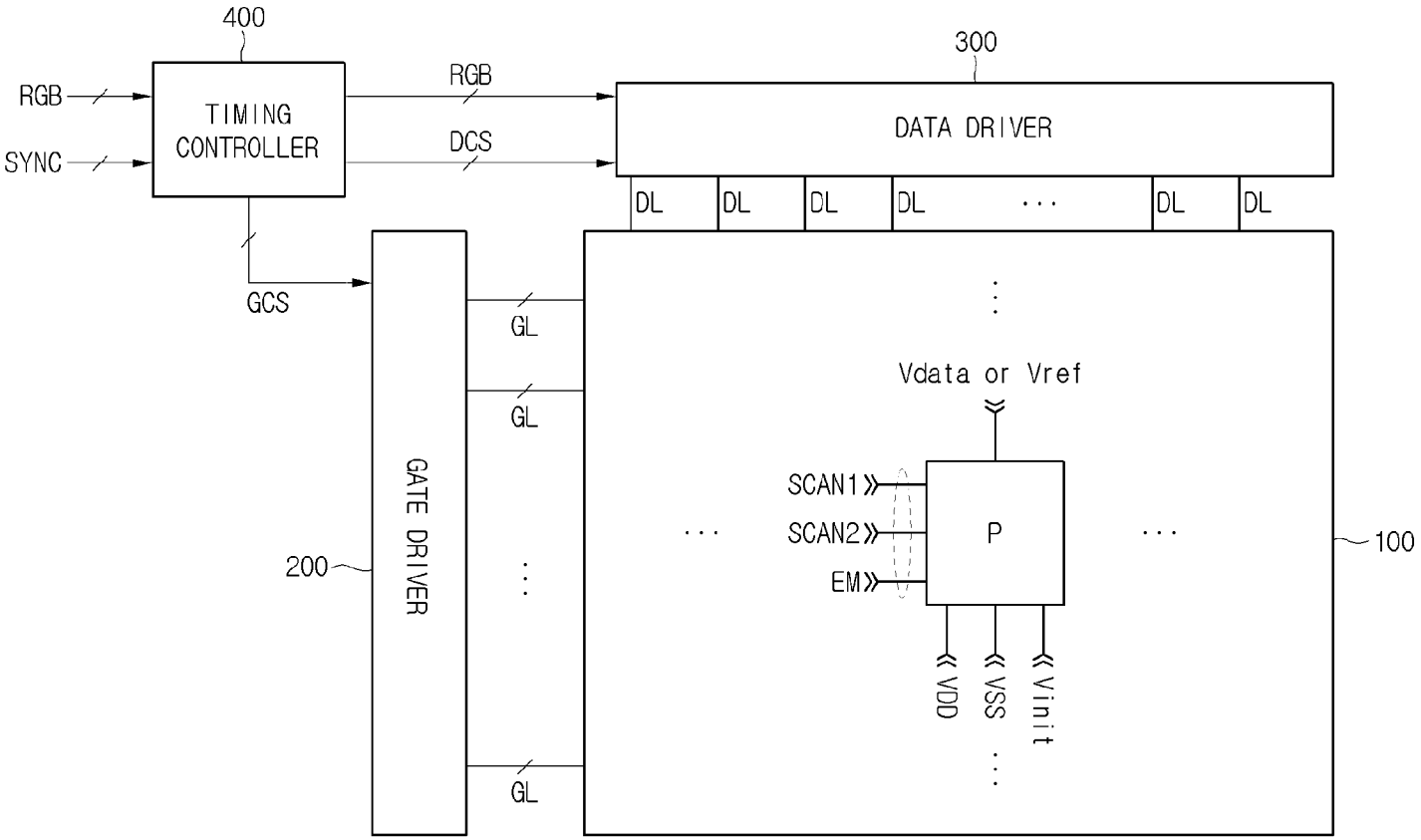
FIG. 5 is a block diagram showing the configuration of an OLED display device according to an embodiment of the present disclosure.
Figure 6:
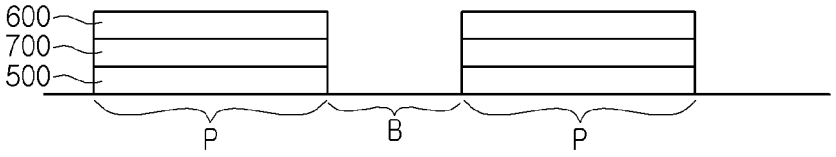
FIG. 6 is a cross-sectional view showing the structure of a pixel region according to an embodiment of the present disclosure.

FIG. 5 is a block diagram showing the configuration of an OLED display device according to an embodiment of the present disclosure. FIG. 6 is a cross-sectional view showing the structure of a pixel region according to an embodiment of the present disclosure.

The OLED display device shown in FIG. 5 may include a display panel 100 defined into pixels by crossing a plurality of gate lines GL and a plurality of data lines DL, a gate driver 200 configured to drive the plurality of gate lines GL, and a data driver 300 configured to drive the plurality of data lines DL, and a timing controller 400 configured to control the gate driver 200 and the data driver 300. The timing controller 200 re-arranges image data RGB applied from an exterior and applies re-arranged image data RGB to the data driver 300. Also, in order to control the gate and data drivers 200 and 300, the timing controller 400 applies gate control signals GCS and data control signals DCS to the gate driver 200 and the data driver 300.

Each pixel P of the OLED display device according to the present disclosure includes an OLED and a cell driver which independently drives the OLED and includes a driving TFT DR used to apply a driving current to the OLED. The cell drivers are each configured to compensate for characteristic deviations between the driving TFTs DR and a voltage drop of a high voltage VDD. Therefore, a brightness deviation between the pixels P can be reduced.

Also, an existing gate line is used as a voltage line for transferring an initialization voltage. As such, configurations of the cell drivers can be simplified. In accordance therewith, an aperture ratio of an organic material deposition region can be enhanced and a bezel region can be reduced.

Such a pixel P of the present disclosure will now be explained in detail with reference to FIGS. 7 through 10.

The display panel 100 includes a plurality of gate lines GL and a plurality of data lines DL crossing each other. Also, the display panel 100 further includes a plurality of pixels P arranged in regions which are defined by the gate and data lines GL and DL crossing each other.

Each of the pixels P includes an OLED and a cell driver. Also, each of the pixels P can be connected to at least one of the gate lines GL, one of the data lines DL, a high voltage supply line VDD and a low voltage supply line VSS.

The gate driver 200 can apply a plurality of gate signals to the plurality of gate lines GL in response to the gate control signals GCS supplied from the timing controller 400.

The plurality of gate signals include first through third scan signals SCANi−1, SCANi and SCANi+1 and an emission signal EM. The plurality of gate signals can be applied to each of the pixels P through the plurality of gate lines GL.

The high voltage VDD has a higher voltage compared to the low voltage VSS. The low voltage VSS can be a ground voltage. An initialization voltage applied through the gate line GL can be set to be a lower voltage than a threshold voltage of the OLED included in each of the pixels P.

The data driver 300 replies to the data control signals DCS applied from the timing controller 400 and convert the digital image data RGB into data voltages Vdata using reference gamma voltages. The converted data voltages Vdata are applied to the plurality of data lines DL.

Such a data driver 300 outputs the data voltages Vdata to the pixels P only during a programming interval t3 (shown in FIG. 7) of the pixels P. In the rest of the intervals, the data driver 300 applies a reference voltage Vref to the plurality of data lines DL.

The timing controller 400 re-arranges an external image data RGB into a suitable format for size and definition of the display panel 100. The re-arranged image data RGB is applied from the timing controller 400 to the data driver 300.

Also, the timing controller 400 generates the gate control signals GCS and the data control signals DCS using synchronous signals input from the exterior. For example, the external synchronous signals may include a dot clock DCLK, a data enable signal DE, a horizontal synchronous signal Hsync and a vertical synchronous signal Vsync. The gate control signals GCS are applied from the timing controller 400 to the gate driver 200 in order to control the gate driver 200. The data control signals DCS are applied from the timing controller 400 to the data driver 300 in order to control the data driver 300.

Referring to FIG. 6, a pixel P according to an embodiment of the present disclosure includes an anode electrode 500, a cathode electrode 600 and an organic emission layer 700 interposed between the two electrodes 500 and 600.

The organic emission layer 700 may include a hole injection layer HIL, a hole transport layer HTL, an emission layer EML, an electron transport layer ETL and an electron injection layer EIL.

Such an organic emission layer 700 may be driven by applying a driving voltage between the anode electrode 500 and the cathode electrode 600. In this case, holes drifted from the anode electrode 500 through the hole injection layer HIL and the hole transport layer HTL and electrons drifted from the cathode electrode 600 through the electron injection layer EIL and the electrode transport layer ETL are recombined with each other within the emission layer EML, thereby generating excitons. The excitons are transitioned from an excited state into a ground state and emit visible light.

The hole transport layer HTL and the electron transport layer ETL enable the holes and the electrons to be efficiently drifted. As such, luminous efficiency of the organic emission layer 700 can be enhanced.

As seen from FIG. 6, any additional electrode for transferring the initialization voltage does not have to be formed in a region B between the pixels P. Therefore, a substantial space can be secured to enhance the aperture ratio of the pixel P.

First Embodiment

Figure 7:
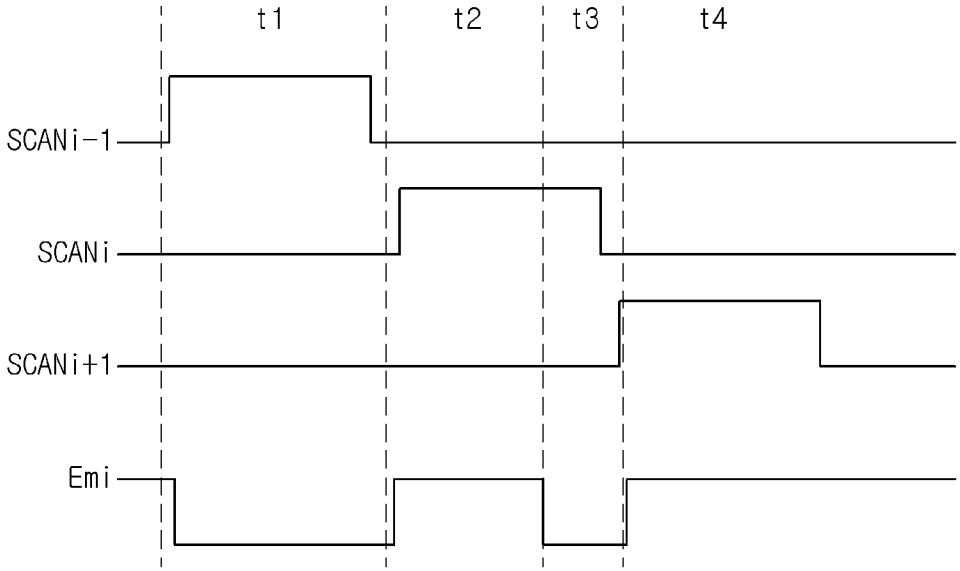
FIG. 7 is a waveform diagram illustrating an operation of a pixel circuit according to a first embodiment of the present disclosure.
Figure 8:
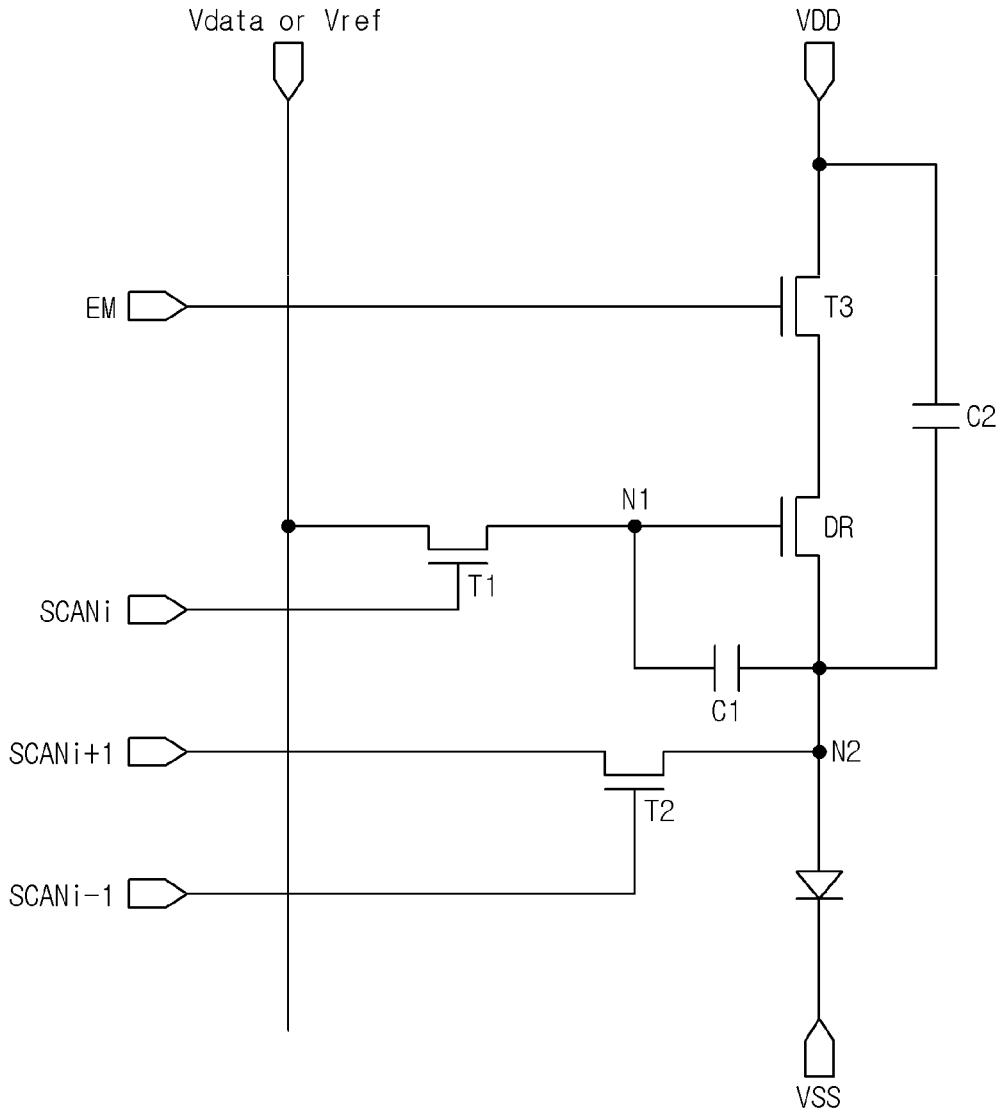
FIG. 8 is a circuit diagram showing the configuration of a pixel region according to a first embodiment of the present disclosure.

FIG. 7 is a waveform diagram illustrating an operation of a pixel circuit according to a first embodiment of the present disclosure. FIG. 8 is a circuit diagram showing the configuration of a pixel region according to a first embodiment of the present disclosure.

As shown in FIG. 7, a pixel P of the OLED display device according to a first embodiment of the present disclosure can be driven in an operation mode which is defined into an initialization interval t1, a sampling interval t2, a programming interval t3 and an emission interval t4 according to pulse timings of the plural gate signals applied to the pixel P.

Meanwhile, the first scan signal SCANi−1, the second scan signal SCANi and the third scan signal SCANi+1 are scan signals which are applied from the gate lines (GL adjacent to one another.

If the second scan signal SCANi is a scan signal which is applied from an ith gate line GLi, the first scan signal SCANi−1 is another scan signal applied from an (i−1)th gate line GLi−1, and the third scan signal SCANi+1 is still another scan signal applied from an (i+1)th gate line GLi+1.

Initialization Interval t1

In the initialization interval t1, the first scan signal SCANi−1 with the high logic level is output, and the second and third scan signals SCANi and SCANi+1 with the low logic level are output.

Sampling Interval t2

During the sampling interval t2, the first scan signal SCANi−1 and the third scan signal SCANi+1 each have the low logic level, and the second scan signal SCANi and the emission signal EM each have the high logic level.

Programming Interval t3

In the programming interval t3, the first and third scan signal SCANi−1 and SCANi+1 and the emission signal EM each maintain the low logic level, and the second scan signal SCANi maintains the high logic level.

Emission Interval t4

During the emission interval t4, the emission signal EM and the third scan signal SCANi+1 each having the high logic level are output, and the first and second scan signals SCANi−1 and SCANi each having the low logic level are output.

Meanwhile, the data driver 300 outputs the data voltages Vdata to the pixels P only during a programming interval t3 of the pixels P. In the rest of the intervals, the data driver 300 applies a reference voltage Vref to the plurality of data lines DL.

Referring to FIG. 8, the pixel P can include an OLED and a cell driver configured with four TFTs and two capacitors.

In detail, the cell driver can includes a driving TFT DR, first through third switching TFTs T1~T3 and first and second capacitors C1 and C2.

The driving TFT DR and the OLED are serially connected between the high voltage supply line VDD and the low voltage supply line VSS. The driving TFT DR is used to apply a driving current to the OLED during the emission interval t4.

The first switching TFT T1 can be turned-on or turned-off according to the level state of the second scan signal SCANi. When the first switching TFT T1 is turned-on, the data line DL is connected to a first node N1 to which a gate electrode of the driving TFT DR is connected.

Such a first switching TFT T1 transfers the reference voltage Vref applied from the data line DL to the first node N1 during the initialization interval t1 and the sampling interval t2. Also, the first switching TFT T1 transfers the data voltage Vdata applied from the data line DL to the first node N1 in the programming interval t3.

The second switching TFT T2 is turned-on or turned-off according to the level state of the third scan signal SCANi+1. When the second switching TFT T2 is turned-on, a low voltage on the (i+1)th gate line GLi+1 is applied to a second node N2 to which a source electrode of the driving TFT DR is connected.

Such a second switching TFT T2 transfers the low voltage on the (i+1)th gate line GLi+1 to the second node N2 during the initialization interval t1. The low voltage can be used in the same way as the reference voltage (or the initialization voltage) Vinit in the related art which is applied from the initialization voltage line Vinit to the second node N2 during the initialization interval t1.

The third switching TFT T3 is turned-on or turned-off according to the level state of the emission signal EM. When the third switching TFT T3 is turned-on, the high voltage VDD is applied to a drain electrode of the driving TFT DR through the third switching TFT T3.

Such a third switching TFT T3 can transfer the high voltage VDD on the high voltage supply line VDD to the drain electrode of the driving TFT DR during the sampling interval t1 and the emission interval t4.

The first capacitor C1 is connected between the first node N1 and the second node N2. Such a first capacitor C1 is charged with a threshold voltage of the driving TFT DR during the sampling interval t2.

The second capacitor C2 can be connected between the high voltage supply line VDD and the second node N2. Also, the second capacitor C2 can be connected to the first capacitor C1 and enable a capacitance ratio of the first capacitor C1 to be relatively reduced. As such, brightness of the OLED with respect to the data voltage applied to the first node N1 can be enhanced.

Subsequently, a method of driving the pixel P according to a first embodiment of the present disclosure will be explained with reference to FIGS. 7 and 8.

First, the second switching TFT 12 is turned-on in the initialization interval t1. As such, the pixel P is initialized by the low voltage of the second scan signal SCANi which is transferred from the ith gate line GLi to the second node N2.

Thereafter, the first and third switching TFTs T1 and T3 are turned-on in the sampling interval t2. Then, the reference voltage Vref is applied from the data line DL to the first node N1, and the high voltage VDD is transferred from the high voltage supply line VDD to the drain electrode of the driving TFT DR. As such, the driving TFT DR changes from a floating state into a turned-on state and allows a current to flow into its source electrode. When the source voltage of the driving TFT DR reaches "Vref−Vth", the driving TFT DR is turned-off. The term of "Vth" is the threshold voltage of the driving TFT DR.

In the programming interval t3, the first switching TFT T1 is turned-on. Then, the data voltage Vdata is transferred from the data line DL to the first node N1 through the first switching TFT T1. As such, the voltage at the second node N2 changes into a voltage of "Vref−Vth+C'(Vdata−Vref)" due to a coupling phenomenon of the first capacitor C1. Here, "C'" is "C1/(C1+C2+Coled)" and "Coled" is a capacitance of the OLED.

The pixel P of the present disclosure includes the second capacitor C2, which may be serially connected to the first capacitor C1, and allows the capacitance ratio of the first capacitor C1 to be relatively reduced. In accordance therewith, brightness of the OLED with respect to the data voltage Vdata which is applied to the first node N1 during the programming interval 13 can be enhanced.

In other words, the coupling phenomenon is generated by a serial circuit of the first capacitor C1 and the second capacitor C2. As such, the voltage at the second node N2 changes into the voltage of "Vref−Vth+C'(Vdata−Vref)," as explained above.

Afterward, in the emission interval t4, the third switching TFT T3 is turned-on and transfers the high voltage VDD to the drain electrode of the driving TFT DR. Then, the driving TFT DR applies a driving current to the OLED. The driving current applied from the driving TFT DR to the OLED can be represented by a following equation 1.

$$I\text{oled}=k/2[(1-C')(V\text{data}-V\text{ref})]^2 \quad \text{[Equation 1]}$$

In the equation 1, "k" is "u·Cox·W/L" and "C'" is "C1/(C1+C2+Coled).

As seen from the equation 1, the driving current of the OLED is not affected by the threshold voltage Vth of the driving TFT DR and the high voltage VDD. In this manner, the pixel P of the present disclosure compensates for characteristic deviations of the driving TFT DR and a drop of the high voltage VDD. As such, brightness deviation between the pixels P can be reduced.

The present disclosure can adjust a rising time of the emission signal EM, which is the time to take to change from the low logic level into the high logic level, at a start time point of the emission interval t4. In accordance therewith, a mobility deviation of the driving TFTs DR can be compensated for.

Also, the OLED display device of the present disclosure removes the initialization voltage supply line and uses the existing gate line in order to apply the initialization voltage, unlike that of the related art. As such, an aperture ratio of the organic emission layer can be enhanced.

Moreover, the OLED display device of the present disclosure can remove one block from a GIP (gate-drive-IC in panel) circuit. Therefore, the size of the bezel can be reduced.

Second Embodiment

Figure 9:
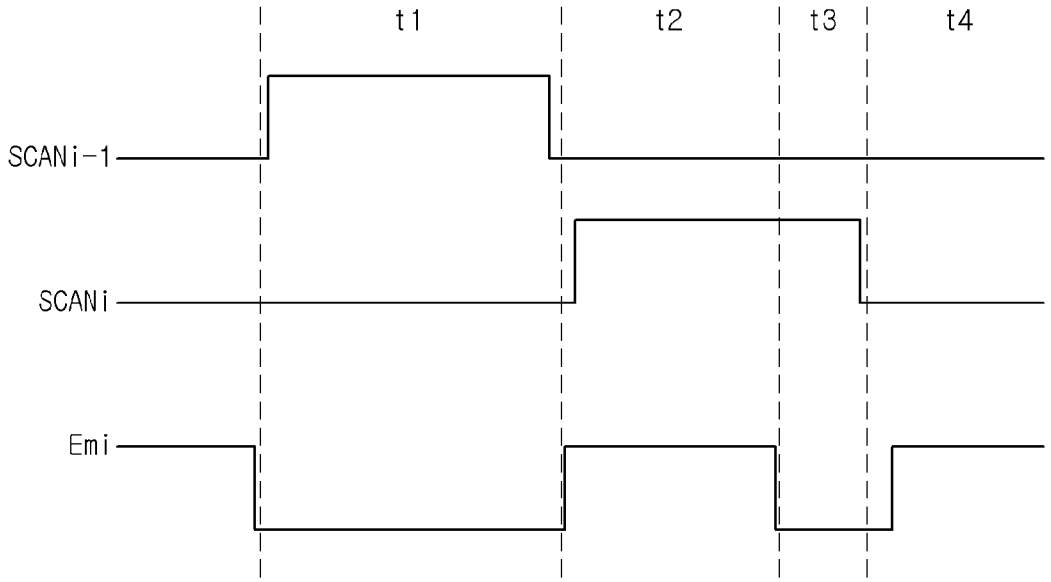
FIG. 9 is a waveform diagram illustrating an operation of a pixel circuit according to a second embodiment of the present disclosure.
Figure 10:
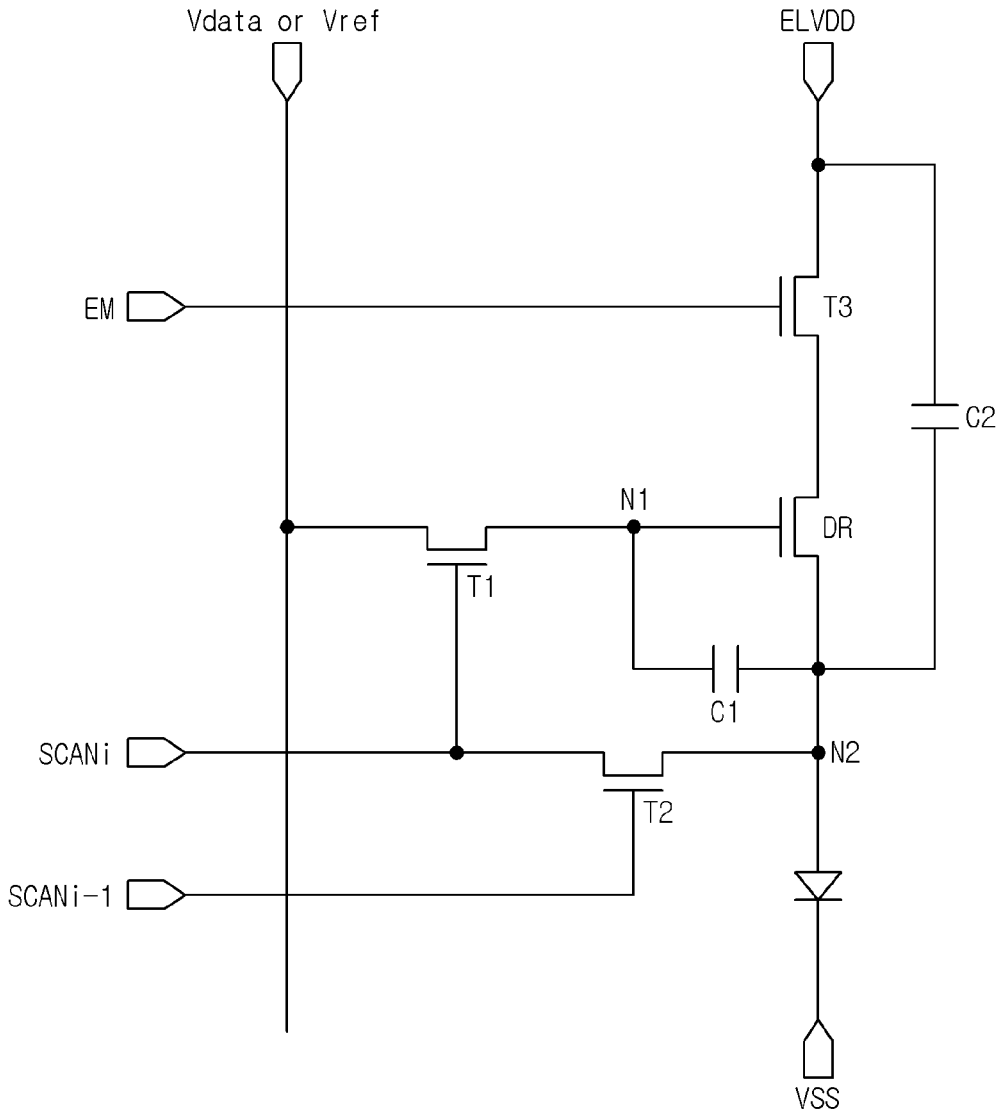
FIG. 10 is a circuit diagram showing the configuration of a pixel region according to a second embodiment of the present disclosure.

FIG. 9 is a waveform diagram illustrating an operation of a pixel circuit according to a second embodiment of the present disclosure. FIG. 10 is a circuit diagram showing the configuration of a pixel region according to a second embodiment of the present disclosure.

As shown in FIG. 9, a pixel P of the OLED display device according to a second embodiment of the present disclosure can be driven in an operation mode which is defined into an initialization interval t1, a sampling interval t2, a programming interval t3 and an emission interval t4 according to pulse timings of the plural gate signals applied to the pixel P.

Initialization Interval t1

In the initialization interval t1, the first scan signal SCANi−1 with the high logic level is output and the second scan signal SCANi with the low logic level are output.

Sampling Interval t2

During the sampling interval t2, the first scan signal SCANi−1 has the low logic level and the second scan signal SCANi and the emission signal EM each have the high logic level.

Programming Interval t3

In the programming interval t3, the first scan signal SCANi−1 and the emission signal EM each maintain the low logic level and the second scan signal SCANi maintains the high logic level.

Emission Interval t4

During the emission interval t4, the emission signal EM having the high logic level is output and the first and second scan signals SCANi−1 and SCANi each having the low logic level are output.

Meanwhile, the data driver 300 outputs the data voltages Vdata to the pixels P only during a programming interval t3 of the pixels P. In the rest of the intervals, the data driver 300 applies a reference voltage Vref to the plurality of data lines DL.

Referring to FIG. 10, the pixel P can include an OLED and a cell driver configured with four TFTs and two capacitors.

In detail, the cell driver can includes a driving TFT DR, first through third switching TFTs T1~T3 and first and second capacitors C1 and C2.

The driving TFT DR and the OLED are serially connected between the high voltage supply line VDD and the low voltage supply line VSS. The driving TFT DR is used to apply a driving current to the OLED during the emission interval t4.

The first switching TFT T1 can be turned-on or turned-off according to the level state of the second scan signal SCANi. When the first switching TFT T1 is turned-on, the data line DL is connected to a first node N1 to which a gate electrode of the driving TFT DR is connected.

Such a first switching TFT T1 transfers the reference voltage Vref applied from the data line DL to the first node N1 during the initialization interval t1 and the sampling interval t2. Also, the first switching TFT T1 transfers the data voltage Vdata applied from the data line DL to the first node N1 in the programming interval t3.

The second switching TFT T2 is turned-on or turned-off according to the level state of the first scan signal SCANi−1. When the second switching TFT T2 is turned-on, a low voltage of the second scan signal SCANi on the ith gate line GLi is applied to a second node N2 to which a source electrode of the driving TFT DR is connected.

Such a second switching TFT T2 transfers the low voltage on the ith gate line GLi to the second node N2 during the initialization interval t1. The low voltage can be used in the same way as the initialization voltage Vinit in the related art which is applied from the initialization voltage supply line Vinit to the second node N2 during the initialization interval t1. As such, the pixel of the second embodiment can have a simplified circuit configuration and be driven in the same manner as to that of the first embodiment shown in FIG. 8.

The third switching TFT T3 is turned-on or turned-off according to the level state of the emission signal EM. When the third switching TFT T3 is turned-on, the high voltage VDD is applied to a drain electrode of the driving TFT DR through the third switching TFT T3.

Such a third switching TFT T3 can transfer the high voltage VDD on the high voltage supply line VDD to the drain electrode of the driving TFT DR during the sampling interval t1 and the emission interval t4.

The first capacitor C1 is connected between the first node N1 and the second node N2. Such a first capacitor C1 is charged with a threshold voltage of the driving TFT DR during the sampling interval t2.

The second capacitor C2 can be connected between the high voltage supply line VDD and the second node N2. Also, the second capacitor C2 can be connected to the first capacitor C1 and enable a capacitance ratio of the first capacitor C1 to be relatively reduced. As such, brightness of the OLED with respect to the data voltage applied to the first node N1 can be enhanced.

A method of driving the pixel P according to a second embodiment of the present disclosure will now be explained with reference to FIGS. 9 and 10.

First, the second switching TFT T2 is turned-on by the first scan signal SCANi−1 with the high voltage during the initialization interval t1. As such, the pixel P is initialized by the low voltage of the second scan signal SCANi which is transferred from the ith gate line GLi to the second node N2.

Thereafter, the first and third switching TFTs T1 and T3 are turned-on in the sampling interval t2. Then, the reference voltage Vref is applied from the data line DL to the first node N1, and the high voltage VDD is transferred from the high voltage supply line VDD to the drain electrode of the driving TFT DR. As such, the driving TFT DR changes from a floating state into a turned-on state and allows a current to flow into its source electrode. When the source voltage of the driving TFT DR reaches "Vref−Vth", the driving TFT DR is turned-off. The term of "Vth" is the threshold voltage of the driving TFT DR.

In the programming interval t3, the first switching TFT T1 is turned-on. Then, the data voltage Vdata is transferred from the data line DL to the first node N1 through the first switching TFT T1. As such, a voltage at the second node N2 changes into a voltage of "Vref−Vth+C'(Vdata−Vref)" due to a coupling phenomenon of the first capacitor C1. Here, "C'" is "C1/(C1+C2+Coled)" and "Coled" is a capacitance of the OLED.

The pixel P of the present disclosure includes the second capacitor C2, which may be serially connected to the first capacitor C1, and allows the capacitance ratio of the first capacitor C1 to be relatively reduced. In accordance therewith, brightness of the OLED with respect to the data voltage Vdata which is applied to the first node N1 during the programming interval t3 can be enhanced.

In other words, the coupling phenomenon is generated by a serial circuit of the first capacitor C1 and the second capacitor C2. As such, the voltage at the second node N2 changes into the voltage of "Vref−Vth+C'(Vdata−Vref)". In "Vref−Vth+C'(Vdata−Vref)", "C'" is "C1/(C1+C2+Coled)" and "Coled" is a capacitance of the OLED.

Such a pixel P according to a second embodiment of the present disclosure includes the second capacitor C2 and allows the capacitance ratio of the first capacitor C1 to be relatively reduced. Therefore, brightness of the OLED with respect to the data voltage Vdata which is applied to the first node N1 during the programming interval t3 can be enhanced.

Afterward, in the emission interval t4, the third switching TFT T3 is turned-on and transfers the high voltage VDD to the drain electrode of the driving TFT DR. Then, the driving TFT DR applies a driving current to the OLED. The driving current applied from the driving TFT DR to the OLED can be represented by the above-mentioned equation 1.

As seen from the equation 1, the driving current of the OLED is not affected by the threshold voltage Vth of the driving TFT DR and the high voltage VDD. In this manner, the pixel P according to a second embodiment of the present disclosure compensates for characteristic deviations of the driving TFT DR and a drop of the high voltage VDD. As such, brightness deviation between the pixels P can be reduced.

The present disclosure can adjust a rising time of the emission signal EM, which is the time to take to change from the low logic level into the high logic level, at a start time point of the emission interval t4. In accordance therewith, a mobility deviation of the driving TFTs DR can be compensated for.

Also, the OLED display device of the present disclosure removes the initialization voltage supply line and uses the existing gate line in order to apply the initialization voltage, unlike that of the related art. As such, an aperture ratio of the organic emission layer can be enhanced.

Moreover, the OLED display device of the present disclosure can remove one block from a GIP (gate-drive-IC in panel) circuit. Therefore, the size of the bezel can be reduced.

Although the present disclosure has been limitedly explained regarding only the embodiments described above, it should be understood by the ordinary skilled person in the art that the present disclosure is not limited to these embodiments, but rather that various changes or modifications thereof are possible without departing from the spirit of the present disclosure. Accordingly, the scope of the present disclosure shall be determined only by the appended claims and their equivalents without being limited to the description of the present disclosure.

What is claimed is:

1. A display device comprising:

a plurality of pixels each including a light emitting element and a cell driver configured to drive the light emitting element, the cell driver including:

a driving switch element serially connected with the light emitting element between a high voltage supply line and a low voltage supply line;

a first switch element configured to, in response to a second scan signal, connect a data line with a first node to which a gate electrode of the driving switch element is connected;

a second switch element configured to, in response to a first scan signal, apply a third scan signal to a second node to which a source electrode of the driving switch element is connected; and a third switch element configured to, in response to an emission signal, connect the high voltage supply line with a drain electrode of the driving switch element, wherein the first scan signal is applied from an (i−1)th gate line, the second scan signal is applied from an ith gate line, and the third scan signal is a applied from an (i+1)th gate line, and wherein when the second switch element is turned-on during an initialization interval, a low voltage of the third scan signal applied from the (i+1)th gate line is applied as an initialization voltage to the second node to which a source electrode of the driving switch element is connected.

2. The display device of claim 1, wherein the cell driver further includes a first capacitor connected between the first node and the second node.

3. The display device of claim 2, wherein the cell driver further includes a second capacitor connected between the second node and the high voltage supply line and configured to reduce a capacitance ratio of the first capacitor and increase brightness of the light emitting element with respect to a data voltage applied from the data line to each pixel.

4. The display device of claim 1, wherein the first through third scan signals sequentially rise from a logic low to a logic high.

5. A method driving an organic light emitting diode display device with a plurality of pixels each including a light emitting element and a cell driver which is configured to drive the light emitting element, the cell driver including a driving switch element serially connected with the light emitting element between a high voltage supply line and a low voltage supply line; a first switch element configured to, in response to a second scan signal, connect a data line with a first node to which a gate electrode of the driving switch element is connected; a second switch element configured to, in response to a first scan signal, apply a third scan signal to a second node to which a source electrode of the driving switch element is connected; and a third switch element configured to, in response to an emission signal, connect the high voltage supply line with a drain electrode of the driving switch element, the method comprising:

an initialization process initializing the second node by turning-on the second switch element;

a sampling process sensing a threshold voltage of the driving switch element by turning-on the first and third switch elements;

a programming process writing the data voltage into each pixel by turning-on the first switch element; and an emission process enabling the driving switch element to apply a driving current to the light emitting element by turning-on the third switch element, wherein the first scan signal is applied from an (i−1)th gate line, the second scan signal is applied from an ith gate line, and the third scan signal is applied from an (i+1)th gate line, and wherein when the second switch element is turned-on during an initialization interval, a low voltage of the third scan signal applied from the (i+1)th gate line is applied as initialization voltage to the second node to which a source electrode of the driving switch element is connected.

6. The method of claim 5, wherein the initialization process allows the third scan signal to be applied to the second node by turning-on the second switch element.

7. The method of claim 6, wherein the sampling process includes:

applying a reference voltage from the data line to the first node by turning-on the first switch element;

supplying the high voltage applied from the high voltage supply line to the drain electrode of the driving switch element by turning-on the third switch element; and enabling a voltage at the source electrode of the driving switch element to change into a voltage of Vref−Vth, wherein Vref is the reference voltage, and the Vth is the threshold voltage of the driving switch element.

8. The method of claim 7, wherein the programming process includes:

applying the data voltage from the data line to the first node by turning-on the first switch element;

reducing a capacitance ratio of a first capacitor connected between the first node and the second node, using a second capacitor connected between the second node and the high voltage supply line; and allowing a voltage at the source electrode of the driving switch element to change into a voltage of Vref−Vth+C'(Vdata−Vref), and wherein Vdata is the data voltage, C' is the capacitance ratio of C1/(C1+C2+Coled), C1 is a capacitance of the first capacitor, C2 is a capacitance of the second capacitor, and Coled is a capacitance of the light emitting element.

9. The method of claim 8, wherein the emission process includes:

applying the high voltage from the high voltage supply line to the drain electrode of the driving switch element by turning-on the third switch element; and allowing the driving current, which is applied from the driving switch element to the light emitting element, to become $K/2\cdot\{Vdata-Vref-C'(Vdata-Vref)\}\cdot 2$, and wherein K is a constant value in accordance with mobility and parasitic capacitance of the driving switch element.

10. The method of claim 5, wherein the first through third scan signals sequentially rise from a logic low to a logic high.

11. A display device comprising:

a plurality of pixels each including a light emitting element and a cell driver configured to drive the light emitting element, the cell driver including:

a driving switch element serially connected with the light emitting element between a high voltage supply line and a low voltage supply line;

a first switch element configured to, in response to a second scan signal, connect a data line with a first node to which a gate electrode of the driving switch element is connected;

a second switch element configured to, in response to a first scan signal, apply a third scan signal to a second node to which a source electrode of the driving switch element is connected; and a third switch element configured to, in response to an emission signal, connect the high voltage supply line with a drain electrode of the driving switch element, wherein the first scan signal is applied from an (i−1)th gate line, the second scan signal is applied from an ith gate line, and the third scan signal is applied from an (i+1)th gate line, and wherein a rising time of the emission signal is adjusted to compensate for a mobility deviation of the driving switch element.

* * * * *